US008540105B2

(12) United States Patent
Yasui

(10) Patent No.: US 8,540,105 B2
(45) Date of Patent: Sep. 24, 2013

(54) EASILY OPENABLE CAN AND METHOD OF OPENING THE CAN

(76) Inventor: Norio Yasui, Kanagawa (JP)

( * ) Notice: Subject to any disclaimer, the term of this patent is extended or adjusted under 35 U.S.C. 154(b) by 688 days.

(21) Appl. No.: 11/993,864

(22) PCT Filed: May 19, 2006

(86) PCT No.: PCT/JP2006/310062

§ 371 (c)(1),
(2), (4) Date: Dec. 9, 2009

(87) PCT Pub. No.: WO2006/126463

PCT Pub. Date: Nov. 30, 2006

(65) Prior Publication Data

US 2010/0108678 A1 May 6, 2010

(30) Foreign Application Priority Data

May 23, 2005 (JP) ..... 2005-178499
Dec. 8, 2005 (JP) ..... 2005-380869
May 11, 2006 (JP) ..... 2006-133030

(51) Int. Cl.
*B65D 43/03* (2006.01)

(52) U.S. Cl.
USPC ..... 220/380; 220/23.6; 220/23.4; 220/277; 220/906; 206/504; 206/508; 206/509

(58) Field of Classification Search
USPC ..... 220/23.6, 23.4, 23.2, 380, 258.4, 220/277, 89.3, 6.25, 906, 4.27, 0.25; 206/509, 206/511, 503, 504, 508
See application file for complete search history.

(56) References Cited

U.S. PATENT DOCUMENTS 2,149,308 A * 3/1939 Peckham ..... 220/267
2,957,601 A * 10/1960 Novick ..... 206/503
3,139,211 A * 6/1964 Foltz, Jr. ..... 220/277
3,815,281 A * 6/1974 Kander ..... 446/77
4,386,713 A * 6/1983 Baumeyer et al. ..... 220/269
4,913,305 A * 4/1990 Hanafusa et al. ..... 220/269
4,930,636 A * 6/1990 Meadows ..... 206/503
5,076,430 A * 12/1991 Philpot ..... 206/430
5,573,133 A * 11/1996 Park ..... 220/4.27

* cited by examiner

*Primary Examiner* — Mickey Yu
*Assistant Examiner* — Kareen Rush
(74) *Attorney, Agent, or Firm* — Joseph L. Strabala

(57) ABSTRACT

An easily openable metal can largely openable in the arranged state of two sheet metal-made cans in series. A means such as a projection for opening the drinking mouth of another can is formed at the lower part of a can body, and a break line and a means for guiding the means such as the projection are formed at the upper part thereof.

4 Claims, 8 Drawing Sheets

EASILY OPENABLE CAN AND METHOD OF OPENING THE CAN

FIELD OF THE INVENTION

The present invention relates to an easily openable can and a method of opening the same which enlarges the opening so as to facilitate dispensing content such as canned beer or canned juice.

DESCRIPTION OF THE RELATED ART

Canned beer and juice have openings formed such that a peripheral edge portion of a lid plate is seamed and fixed around an upper edge portion of a can body made of aluminum or steel plate, a pull-tab is fixed in the center of an upper surface of the can lid with a rivet, and a score (cutting line) is press-formed on the periphery of the pull-tab portion. And by pulling the pull-tab up, the scored portion breaks and separates from the lid plate and is pushed into the can body, and through which a drinking mouth is formed (See Japanese patent application Kokai publication No. 2006-1586 or the like).

According to the patent document and other known arts, the opening portion opened by pulling the pull-tab up is formed in an arc in various shapes and sizes.

The size of the drinking mouth of such a can is determined with a relationship between strength and ease of opening to withstand a pressure inside the can and an external impact and to preserve the content normally. In the case of recent beer cans, the oval drinking mouth is formed with a width of approximately 40 to 43% and a height of approximately 35% of the diameter of a center panel constituting the lid plate. However, as a drinking mouth, it does not ensure a sufficient size (See Japanese patent application Kokai publication No. 2006-1586 or the like).

In the case of canned beer and juice, in particular canned beer, briskness when flowing down the throat is the most important, and hence, when people usually drink canned beer, they avoid repeated drinking small amounts from a small drinking mouth of it by transferring the content to a container such as a glass or a jug for more comfortable drinking.

However, in order to transfer the content of canned beer to a glass or the like before drinking it, a container such as a glass needs to have been prepared all the time and in the case of outdoor or large parties, such preparation can be impossible, and many people are forced to drink small amounts directly from the can.

When drinking canned beer or juice, it often results in a plurality of cans lying around, and the present invention was made in view of this point. That is, with beer cans that are restricted in that dispensing can only be done in small amounts such as with those currently available, a function to open a larger drinking mouth is provided, two cans are vertically stacked upon each other, and by fixing the lower can, for example, while rotating the upper can, an easily openable can is provided that can open the drinking mouth larger than those previously found.

SUMMARY OF THE INVENTION

In order to solve the above problem, a structure of an easily openable can and its opening method according to the present invention is that a function for assisting opening such as a break line at an upper part of a metal can and a can with means for opening another can at a lower part are provided, and one of the cans is opened by rotating and manipulating the two cans having the both functions in a connected state, which is configured as follows.

1) An opening method of an easily openable can according to the present invention is characterized in that a can with means for opening a sheet metal-made can at a lower part and a function for assisting opening at an upper part is used as a pair.

2) A structure of an easily openable can according to the present invention is characterized in that in a can which is to be opened in an arranged state of two sheet metal-made cans in series, means for opening a drinking mouth of another can is provided at a lower part of the can, and a function for assisting opening of the can itself is formed at an upper part.

3) A break line is formed in parallel with an inner surface of a ringed seaming portion formed on the periphery of a lid plate at an upper part of a sheet metal-made can or an inner surface of the seaming portion on the upper surface of the lid plate, and a projection for generating a pressing force for breaking the break line is formed on the surface of a reduced portion at the lower part of the can.

4) A chuck wall of a ringed seaming portion formed on the periphery of a lid plate at an upper part of a sheet metal-made can is slightly extended into the inside of the can, a break line is formed along the seaming portion in the extended portion, and a projection for generating a pressing force for breaking the break line is formed.

5) An inclined guide projection is formed on an inner surface of a ringed seaming portion formed on the periphery of a lid plate at an upper part of a sheet metal-made can, a guide projection to be fitted in the guide projection to bring the two cans into the connected state is formed on the surface of a reduced portion at a lower part of the can, a breaking projection is formed on the lower surface of the main body, and moreover, a break line constituting a part of a circle is formed at a position corresponding to the breaking projection on the periphery of the lid plate on the inner surface of the seaming portion of the can.

6) A break line not more than a half circumference is formed along a seaming portion slightly below the ringed seaming portion formed on the periphery of a lid plate at an upper part of a sheet metal-made can, a projecting guide portion is also formed opposing to the break line, and a projection fitted between the break line and the guide portion for breaking the break line is formed on the inner surface of a reduced portion at a lower part of the can.

7) A folding line is formed at a position substantially connecting both ends of the break line, and a pull-tab having a fixed portion is provided at a portion of a lid plate where the guide portion is provided.

By the configuration as above, in the present invention, means for generating a breaking force is provided at a reduced portion at a lower part of a sheet metal-made can as a beer can which can be stacked, and a break line is further formed inside a seaming portion at an upper part of the can so that a large drinking mouth as if it is a cup can be easily opened without using a special can-opening device by applying relative rotation between the two cans connected vertically.

Also, since a large drinking mouth is formed as compared with a conventional beer can, beer can be drunk with comfort of flowing down the throat favorably.

Moreover, only by slightly changing the structure of a conventional beer can using a simple assisting tool, a large drinking mouth can be opened.

BRIEF DESCRIPTION OF THE DRAWINGS

FIG. 8(*b*) is a front sectional view illustrating a variation of a lower part of the beer can shown in FIG. 7.

FIG. 10 is a plan view of the beer can shown in. FIG. 7.

DETAILED DESCRIPTION OF THE INVENTION

Next, a technical idea of the present invention will be described by embodiments referring to the attached drawings but the present invention is not limited to them.

Embodiment 1

Figure 1:
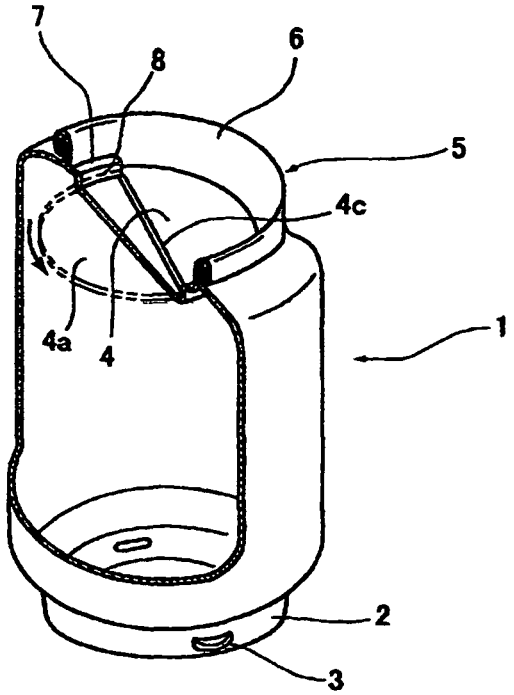
FIG. 1 is a partially broken perspective view of a beer can according to a first embodiment.
Figure 2:
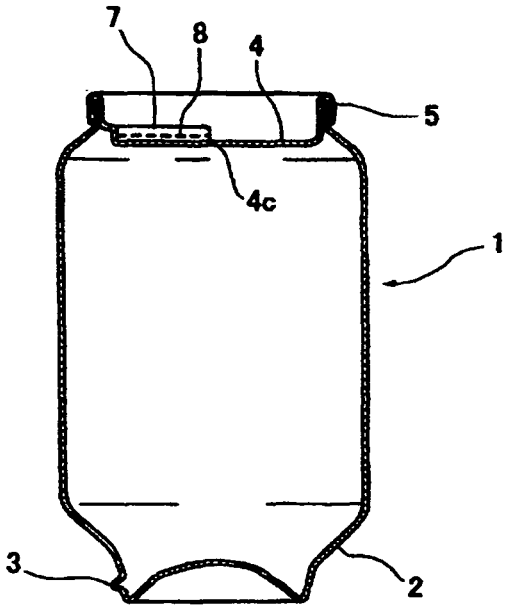
FIG. 2 is a front sectional view of the beer can shown in FIG. 1.
Figure 3:
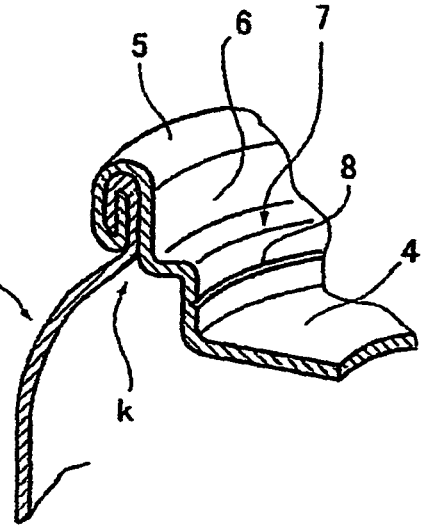
FIG. 3 is an enlarged view of a part with a seaming portion cut away in the beer can shown in FIG. 1.

FIG. 1 is a perspective view illustrating a part of a beer can body, FIG. 2 is a longitudinal sectional view and FIG. 3 is an enlarged sectional view of opening means.

In the case of a beer can, a body 1 is formed capable of being stacked, but in this embodiment, utilizing the characteristics of this basic shape, a projection 3 as opening means is formed at a fitting portion 2 reduced at a lower part of the body 1, a chuck wall 6 forming an annular seaming portion 5 for connecting the body 1 and a lid plate 4 at an upper part is slightly extended into the body 1, an annular portion 7 is expanded at a half circumference portion inside, and a break line 8 is formed at its longitudinal piece portion.

Though not shown, a pull-tab is fixed by a rivet in the center portion of the lid plate 4 as in a usual can so that when the score 8 is broken, a portion where the break line 8 is not formed is connected to the body 1, while a lid body (opening piece) 4*a* (lid plate portion broken or to be broken) formed of a broken portion can be manipulated to push into the body 1 so as to open (or close as necessary) a drinking mouth.

As the opening means, a single piece (or a plurality of pieces depending on the case) of the projection 3 is formed on the surface of the fitting portion 2 which is reduced and tapered. Also, the break line 8 is formed in a dimensional relationship that the projection 3 is just located at the end of an annular portion 7 when the fitting portion 2 of another can is fitted on the seaming portion 5 of a lower can of two cans.

The break line 8 has a limited thickness to be carved so that it withstands pressure inside the can body 1 and an impact at transportation and handling and has a strength to be broken only after pressed by the projection 3. And a space portion k is formed in the state where its back surface can be freely expanded when the break line 8 is pressed by the projection 3.

When a beer can is to be opened, the projection 3 of the fitting portion 2 at the lower end of another beer can 1 (manipulating can) is brought into contact with the seaming portion 5 of the lid body 4 of the beer can 1 on the opening side (opening-side can) at the end of the annular portion 7 to accomplish an opening preparation state. This state can be realized merely by dropping the fitting portion 2 into the seaming portion 5 and rotating it so that the projection 3 matches the guide portion 7. When the two beer cans are prepared in this way, the beer can 1M, which is the manipulating can (upper can) is rotated and the projection 3 is gently rotated and moved along the break line 8 formed in the center of the annular portion 7 of the lower beer can 1 for breaking manipulation so as to separate a part of the lid plate 4 to have a lid-body portion supported by a hinge, and a pull-tab, not shown, is manipulated so as to form a large drinking mouth.

It is only necessary that the break line 8 is provided in a range of approximately ½ to ⅗ of the periphery of the lid plate 4, and a single projection 3 is enough for breaking manipulation of the break line 8 in this range.

When approximately a half of the periphery of the lid plate 4 is separated from the body by the manipulation as above and the broken lid-plate portion is dropped into the can by a necessary depth, a large drinking mouth is opened. And beer, which is content, can be dispensed through the drinking mouth in a short time. As a result, beer can be drunk more favorably as flowing down than conventional can beer.

Embodiment 2

Figure 4:
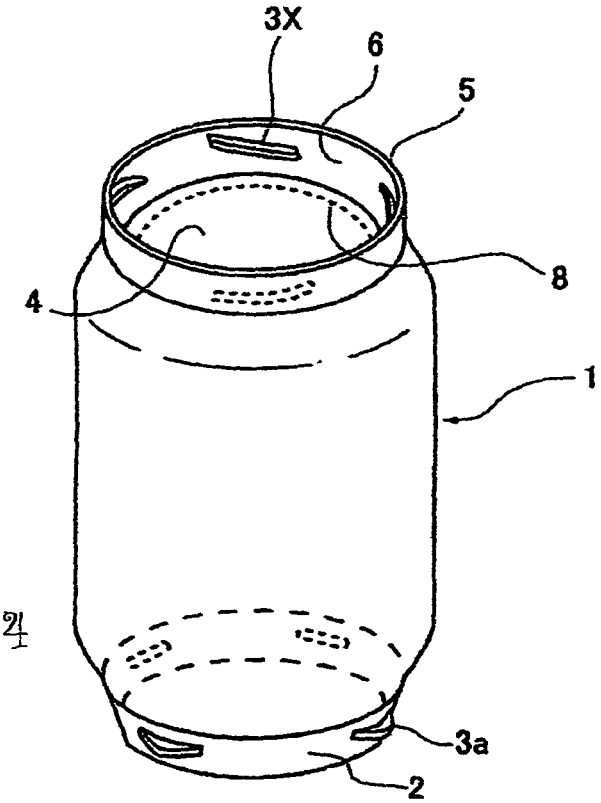
FIG. 4 is a perspective view of a beer can according to a second embodiment.
Figure 5:
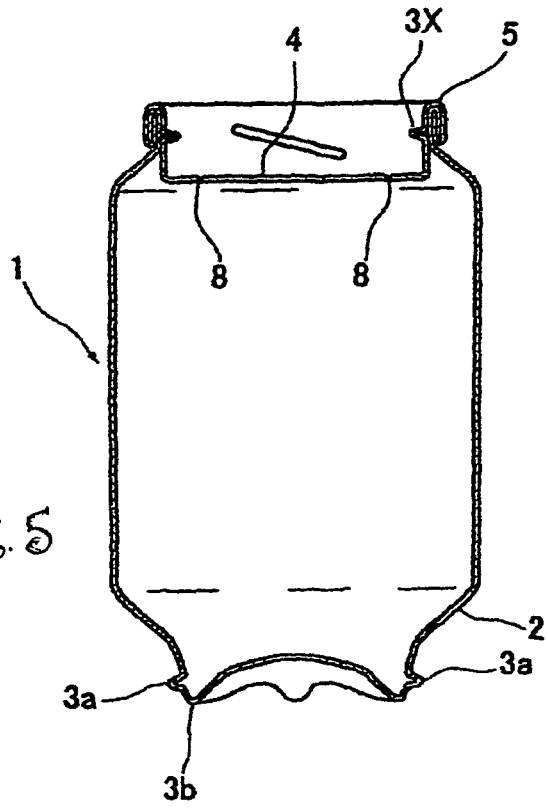
FIG. 5 is a front sectional view of FIG. 4.
Figure 6:
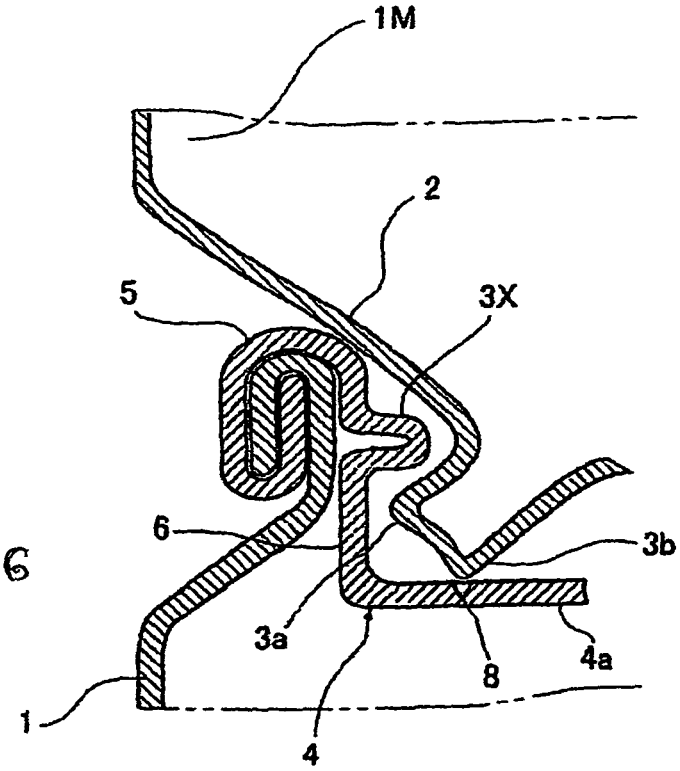
FIG. 6 is an enlarged view of an essential part illustrating an opened state of the beer can shown in FIG. 4.

In this embodiment, as shown in FIGS. 4 to 6, screwing type opening means is provided, in which two types of projections, that is, a plurality of guide projections 3*a* and breaking projections 3*b* as opening means on the periphery of the fitting portion 2 at the lower part of the beer can 1 are formed. And at the chuck wall 6 forming the annular seaming portion 5 at the upper part of the beer can 1, a diagonal guide projecting streaks 3X forming a part of a right screw as opening means are formed at a plurality (four in this example) of spots.

The breaking portion in this example is the score 8 formed by press into the c-shape on the lid plate 4. In the first embodiment, it is formed at the lower part where the chuck wall 6 is extended, while in this embodiment, it is formed on the periphery of the lid body 4, which is a difference. In this embodiment too, a pull-tab provided in the center of the lid body 4 is not shown.

The guide projecting streaks 3X and the four guide projections 3*a* guided by them are provided with a predetermined interval. It is only necessary for the inclination angle of the guide projecting streak 3X to correspond to a pressing-down amount of the can on the manipulation side which can break by pressing the break line 8 with the breaking projection 3*b*. Also, the breaking projection 3*b* may be formed in the annular state, but in this case, breaking manipulation might not be carried out efficiently, and thus, the projection is formed in the shape which can be broken with an interval shorter than the interval of the guide projecting streaks 3X.

Though rotation manipulation of the can on the manipulation side is used as can-opening manipulation in the first embodiment, in this embodiment, on the other hand, as shown in FIG. 6, the manipulation is carried out by pressing-down by the guide projecting streak 3X and breaking at a plurality of breaking projections 3*b* at the same time, which is a difference. In this embodiment, since the break line 8 can be formed in the circumferential direction of the flat-plane state lid plate 4, manipulation to form the break line 8 is easy, and a die can be manufactured inexpensively.

Embodiment 3

This embodiment is to open approximately a half of the lid body 4, and as shown in FIGS. 7 to 10, the chuck wall 6 on the inner surface of the seaming portion 5 and the lid plate 4 are devised.

In this embodiment, the break line 8 is formed substantially over a half circumference of a portion extended below the chuck wall 6 forming the seaming portion 5 on the left half of the lid plate 4 shown in FIGS. 7 and 10. And a guide portion 4*b* with an angular section is formed at a portion opposing to the chuck wall 6. And a straight folding line 4*c* is formed at a boundary portion between the lid plate 4 and the broken lid plate 4*a*.

Figure 8:
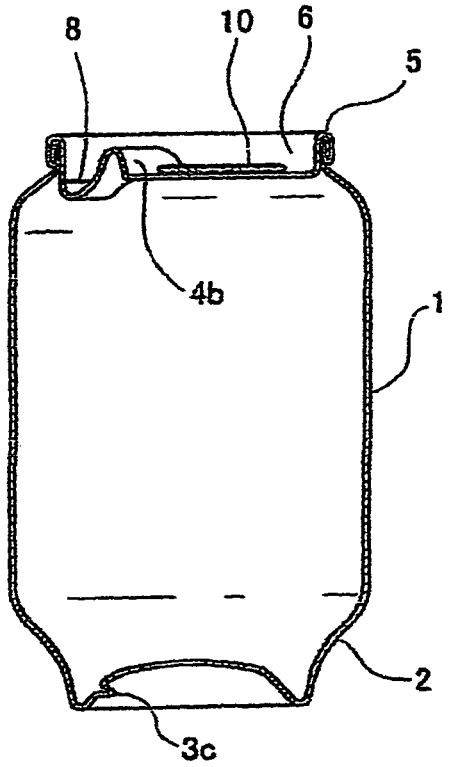
FIG. 8(*a*) is a front sectional view of the beer can shown in FIG. 7.
Figure 8:
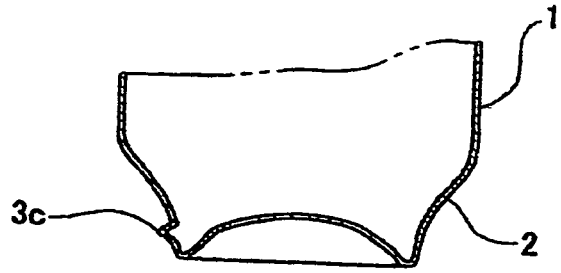
Figure 9:
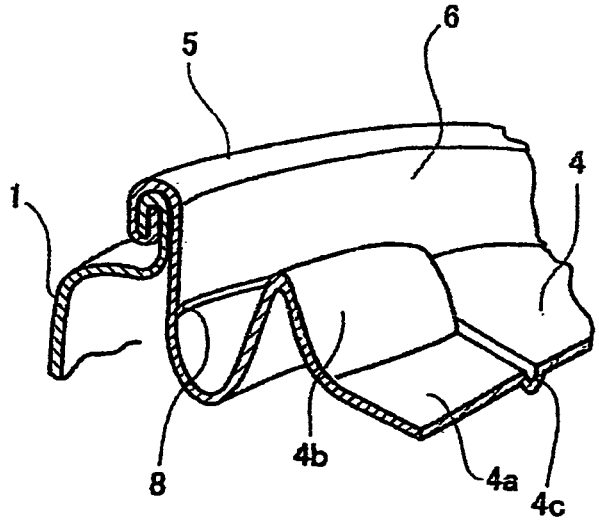
FIG. 9 is an enlarged sectional view illustrating an essential part of the beer can shown in FIG. 7 in a broken manner.

FIG. 8(*a*) shows an example in which a projection 3*c* forming one of opening means at the fitting portion 2 at the lower part of the beer can 1 is formed inward, and when the projection 3*c* is brought into contact with the guide portion 4*b* and pushed into a narrow portion of a trough part, the fitting portion 2 is brought into contact with the chuck wall 6 side, and the projection 3*c* is brought into contact with the guide portion 4*b* at the same time so that the break line 8 between the guide portion 4*b* and the chuck wall 6 is broken.

In this embodiment, the beer can 1 to be opened is placed at a lower side, the fitting portion 3 of another beer can 1M is fitted in the seaming portion 5, the projection 3*c* is brought into contact with the guide portion 4*b*, and moreover, the beer can 1 is rotated while a peripheral edge portion at the tip of the fitting portion 2 is pushed into a narrow trough portion between the guide portion 4*b* and the seaming portion 5 so that the score 8 can be broken.

Figure 7:
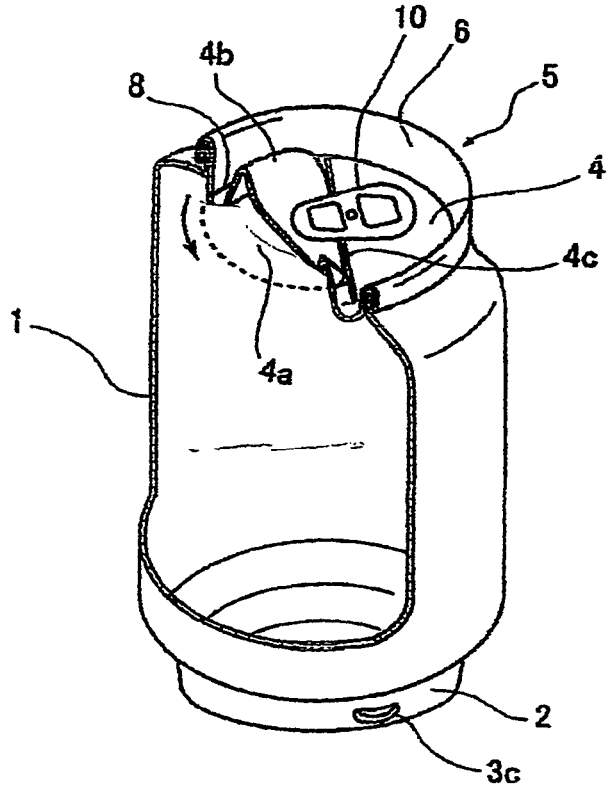
FIG. 7 is a partially broken perspective view of a beer can according to a third embodiment.
Figure 10:
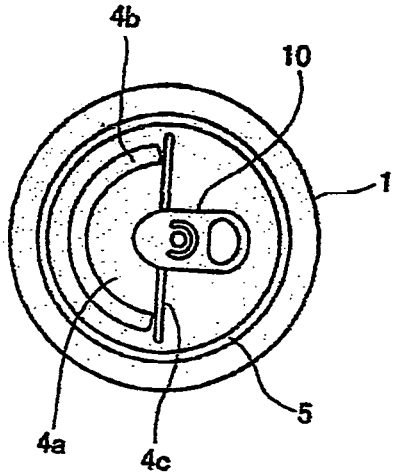

The length of this break line 8 is formed, as shown in FIGS. 7 and 10, in a range of approximately 180 degrees between the folding line 4*c*, and after the break line 8 is broken by rotation of the beer can 1M, which is a can on the manipulating side, by lifting up a free end of the pull-tab 10, the breaking lid plate 4*a* is pushed down into the can with the folding line 4*c* as a hinge so that a drinking mouth formed by a half circle portion between the folding line 4*c* can be opened large.

Also, FIG. 8(*b*) shows a case where the projection 3*c* is formed on the outer surface of the fitting portion 2, and in the case of this example, since the projection 3*c* directly presses and breaks the portion of the break line 8, a force required for breaking may be small and the breaking can be done easily. And this example is characterized in that the projection 3*c* is formed on the outer surface of the reduced portion.

Embodiment 4

Figure 11:
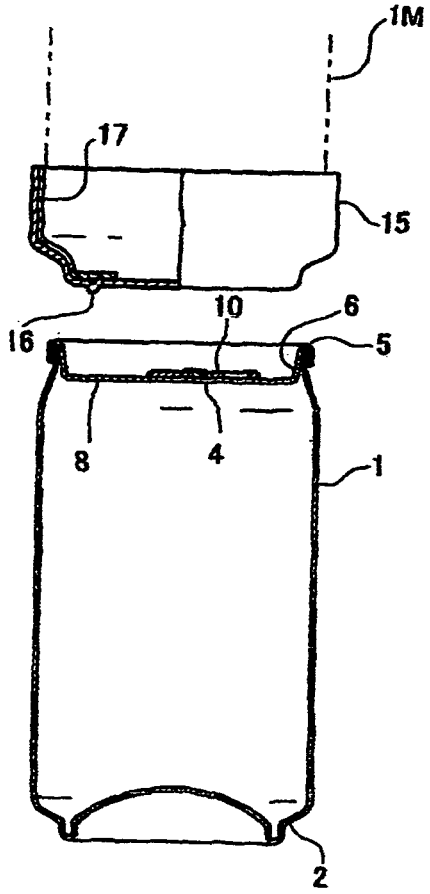
FIG. 11 is an explanatory view illustrating a relationship between an assisting tool according to a fourth embodiment and a beer can to be opened.
Figure 12:
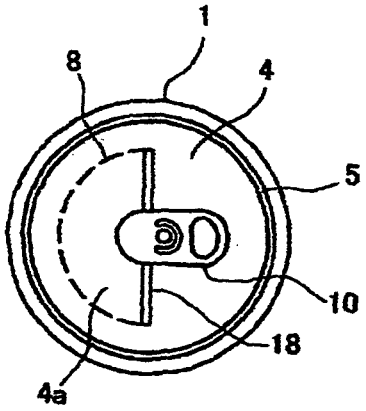
FIG. 12 is a plan view of the beer can shown in FIG. 11.
Figure 13:
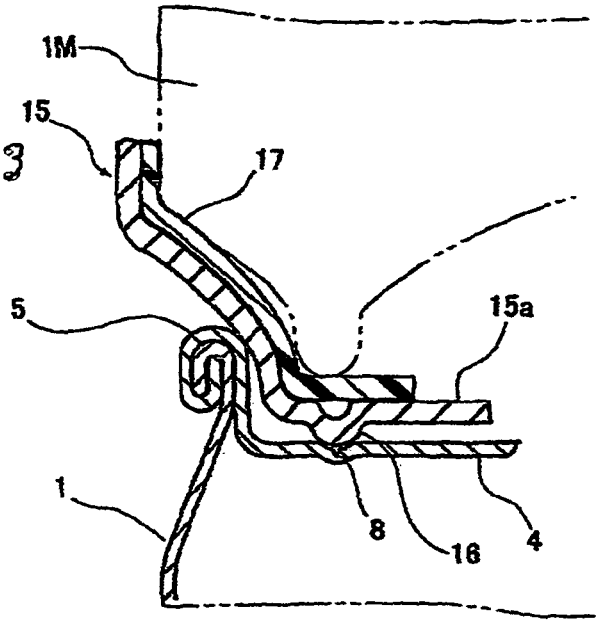
FIG. 13 is an enlarged view of an essential part illustrating an opened state of the beer can shown in FIG. 11.

In this embodiment, the shape of the conventional beer can 1 is not largely changed as shown in FIGS. 11 to 13, but a simple assisting tool is used and one can 1M opens the other can 1 as the "opening-side can 1M and the manipulating-side can 1 of beer cans", which is the basic idea of the present invention.

An assisting tool 15 is formed in a dish state by a circumferential wall and a bottom plate, a single or a plurality of projections 16 are formed on the bottom plate 15*a*, projecting from the inner surface to the outer surface, and moreover, a rubber layer 17 is formed on the entire surface or a part (in points or lines) of the inner surface of the assisting tool 15 (FIGS. 12, 13).

On the lid plate 4 on the upper surface of the can body 1, a folding line 18 is formed in the diameter direction, the break line 8 is formed in the arc state from its both ends, and the pull-tab 10 is fixed in the center of the lid plate 4 (FIG. 12). Also, the reduced portion connecting the circumferential wall to the bottom plate 15*a* is formed with the dimension and shape to be guided by the seaming portion 5 of the beer can 1 (FIG. 13).

When this beer can 1 is to be opened, as shown in FIGS. 11 and 13, the assisting tool 15 is fitted in the lower part of the manipulating-side can 1M on the upper side, the reduced portion of the assisting tool 15 and the bottom plate 15*a* are positioned inside the seaming portion 5 of the opening-side can 1 on the lower side, the projection 16 is brought into contact with the break line 8, and by rotating the manipulating-side beer can 1M to the half, the lid plate 4 is broken in the half moon state. After that, by lifting up the pull-tab 10, the broken lid plate 4*a* is pushed into the can body and the drinking mouth is opened almost to the full extent.

In this embodiment, the break line 8 is formed for 180 degrees, but it is needless to say that the line may be in a range smaller than that. In this case, only a portion to start breaking is broken by the projection 16 and then, the pull-tab 10 is manipulated so as to carry out necessary opening for required breaking. Also, when the pull-tab 10 is used at the same time for opening, the break line 8 is not necessarily in an arc, but a part of it may be formed in the arc state.

Embodiment 5

In this embodiment, the technical idea of the present invention may be applied to a can lid using a screw plug, though not shown. That is, a grip portion capable of engagement with the screw plug (portion having a claw generating a twisting force in a recess portion in which a screw plug is fitted or the screw plug) is formed on the bottom surface of a sheet metal-made can, the grip portion formed on the manipulating-side can is engaged with the screw plug on the opening-side can by twisting the screw plug, and by relatively rotating the two cans, the screw plug can be opened.

What is claimed is:

1. An improved liquid storage unit (1) with a large opening capability includes a container formed of a cylindrical body closed by a lid plate (4) at its top and a bottom plate (2) at its bottom-comprising:

a break away section (4*a*) defined by a break line (8) formed in said lid plate (4) and a socket means (3X, 5, 6) formed above said lid plate; and wedge means (3*a*, 3*b*) formed as part of said bottom plate (2) operable to be received in said socket means and operable to separate said break away section (4*a*) from said lid plate along said break line (8) by applying pressure on said break line (8) when engaged in said socket means and rotated relative thereto whereby a second improved storage container can be used to open said storage container by placing its wedge means in said socket means and twisting said second container relative to said improved liquid container.

2. The improved liquid storage container defined in claim 1 wherein the break line (8) is disposed in a circular configuration in the lid plate (4).

3. The improved liquid storage container defined in claim 1 wherein the length of the break line (8) is from ½ to $3/5^{th}$ of the length of the periphery of the lid plate (4).

4. The improved liquid storage container defined in claim 1 wherein the length of the break line (8) traverses approximately 180 degrees of the diameter of the lid plate with its ends intersecting the ends of a fold line (18 or 4*c*) and said lid plate (4) includes a pull-tab means (10) centrally mounted on said lid plate and operable to fold the break away section (4*a*)

into the container after said break line (8) has been separated from said lid plate when said pull tab is lifted relative to said lid plate.

* * * * *